US005848446A

United States Patent [19]

DeBraal

[11] Patent Number: 5,848,446

[45] Date of Patent: Dec. 15, 1998

[54] SHOWER DOOR ATTACHMENT ASSEMBLY

[75] Inventor: Timothy S. DeBraal, Sheboyan, Wis.

[73] Assignee: Kohler Co., Kohler, Wis.

[21] Appl. No.: 5,294

[22] Filed: Jan. 9, 1998

[51] Int. Cl.[6] ..... A47K 3/22

[52] U.S. Cl. ..... 4/607; 4/557

[58] Field of Search ..... 4/557, 607, 610; 16/90; 49/410, 411

[56] References Cited

U.S. PATENT DOCUMENTS

| | | | |
|---|---|---|---|
| 836,239 | 11/1906 | Buckley . | |
| 1,067,678 | 7/1913 | Prim . | |
| 4,672,694 | 6/1987 | Dusar | 4/607 |
| 4,769,949 | 9/1988 | Glendowne | 7/557 X |
| 4,785,485 | 11/1988 | Etesam | 4/557 |
| 5,031,271 | 7/1991 | Baus . | |

*Primary Examiner*—Robert M. Fetsuga
*Attorney, Agent, or Firm*—Quarles & Brady

[57] ABSTRACT

A shower door assembly is disclosed that has a connector vertically slidably attached to a lower door corner block. The connector corrects for out of plumb conditions when linked to a curb rail. The connector also cleans a track in the rail as the door is moved.

8 Claims, 2 Drawing Sheets

SHOWER DOOR ATTACHMENT ASSEMBLY

CROSS REFERENCES TO RELATED APPLICATIONS

Not applicable.

STATEMENT REGARDING FEDERALLY SPONSORED RESEARCH

Not applicable.

BACKGROUND OF THE INVENTION

This invention relates to shower doors, and more particularly to shower door attachment assemblies.

Shower doors help enclose a shower or tub area to prevent water from collecting on the floor surrounding the shower area, while also allowing entry to the shower area. Conventional shower door assemblies have one or more doors, each having a frame in which a panel of plastic or glass is mounted.

The shower frame can be slidably attached to a fixed track mounted at the top (and usually also at the bottom) of the door opening. At the top of each shower door glides or rollers are typically mounted on hangers, and each glide or roller is movably supported on a fixed track mounted above the shower door opening. The shower door slides along the track to allow access to the shower area. Multiple doors in an assembly are typically offset from each other to allow doors on separate tracks to pass each other. See generally U.S. Pat. No. 4,769,949.

If the surface of a tub has a slight downward bow, or if the curb, track or frame is otherwise out of plumb, a shower door may bind. Therefore, it is desirable to provide a shower door attachment assembly that can correct for this. Some prior art systems do correct for this (e.g. U.S. Pat. No. 4,769,949), but the correction is sometimes unduly complex, expensive, or subject to breakage. Other systems permit the accumulation of dirt and debris in the door tracks, or permit the door to be derailed much too easily.

Therefore, a need exists for a shower door attachment that is self-cleaning, reduces door binding, and resists unintended derailing.

BRIEF SUMMARY OF THE INVENTION

In one aspect, the invention provides a shower door assembly. It has a door, a block on the door adjacent an edge of the door, a connector vertically slidably linked to the block, and a curb rail longitudinally slidably connected to the connector.

Preferably, the block has a cavity and end holes at opposed ends of the cavity. Also preferably, the connector has a top and a bottom, the top having a slotted hole longitudinally extending therethrough that is inserted into said cavity. The slotted hole can have a vertical centerline, and the bottom can have a connection portion. The bottom connection portion is then offset from the vertical centerline of the slotted hole.

In another aspect, the bottom connection portion is cylindrical, and the connector top is vertically slidably attached to the block by a pin inserted into the end holes of the block and the slotted hole of the connector top.

In yet another aspect, the curb rail has a c-shaped track for receiving the bottom connection portion, the pin is threadably engaged with one or more of said end holes, and the block has at least one bumper.

The present invention provides a shower door attachment assembly that can be attached to the shower door in a way that permits vertical play. Also, the system automatically cleans the track.

A primary object of the present invention is to provide a shower door attachment assembly that corrects for out of plumb variations. This is accomplished by mounting blocks near edges of the door allowing a connector to slide in a vertical direction on a pin inside a cavity of each corner block.

Another main object of the present invention is to provide a system of the above type that cleans the curb rails. This is achieved using a cylindrical lobe that slides through a c-slot in the rail.

Another object of the present invention is to provide a shower attachment assembly that is not subject to easy derailment.

These and still other objects and advantages of the present invention will be apparent from the description which follows.

DETAILED DESCRIPTION OF THE PREFERRED EMBODIMENT

Figure 1:
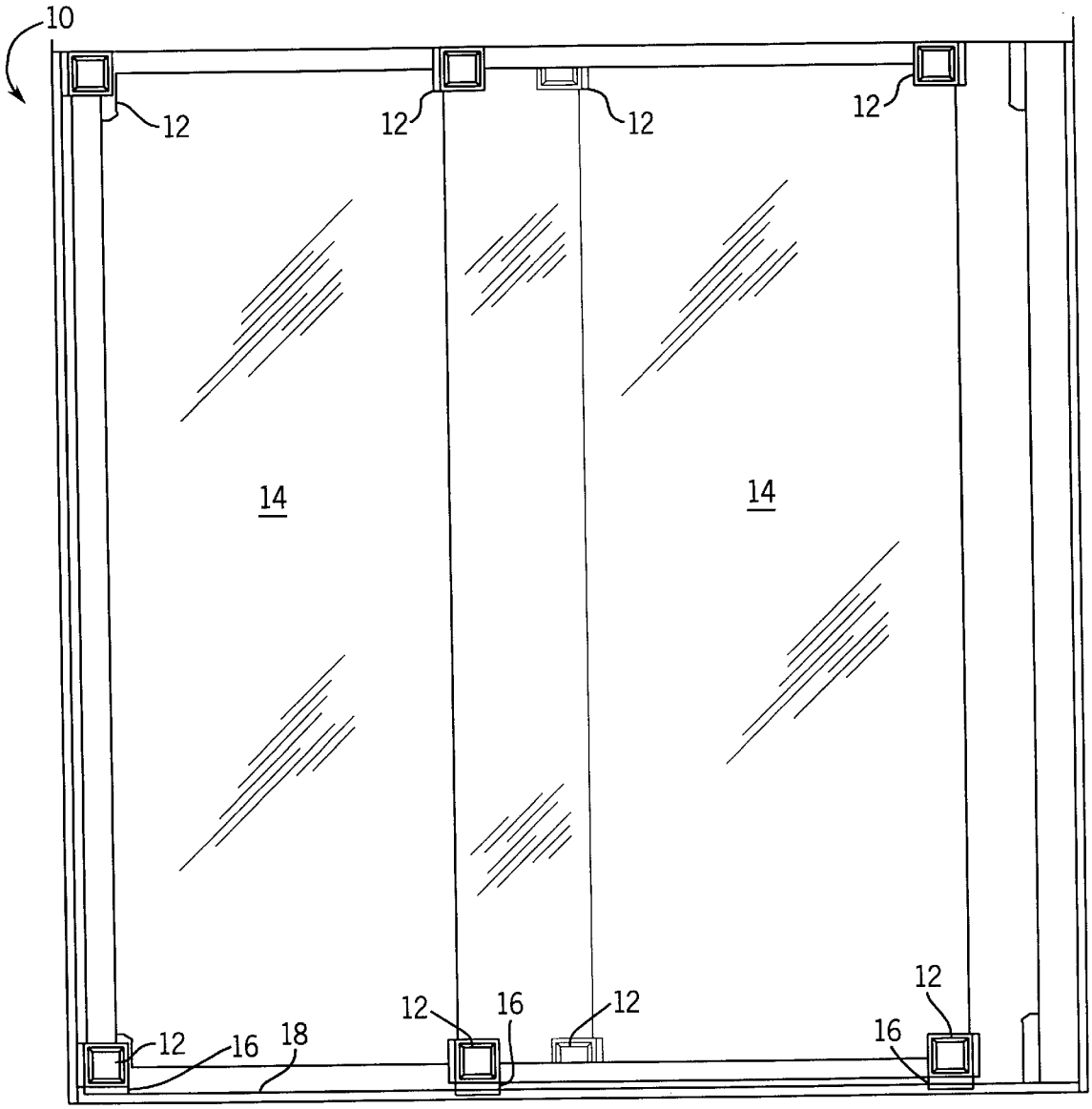
FIG. 1 is a rear elevational view of a bypass shower door which employs the present invention.
Figure 5:
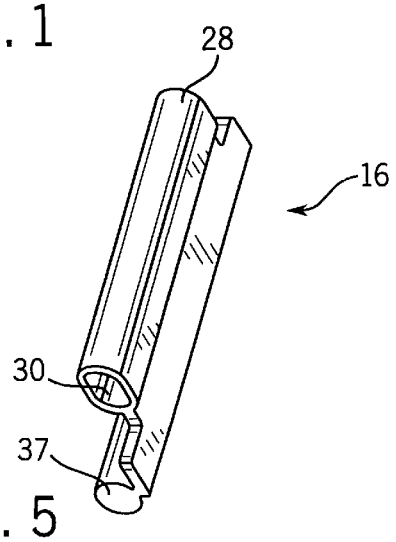
FIG. 5 is a perspective view of a link connector of the present invention.
Figure 6:
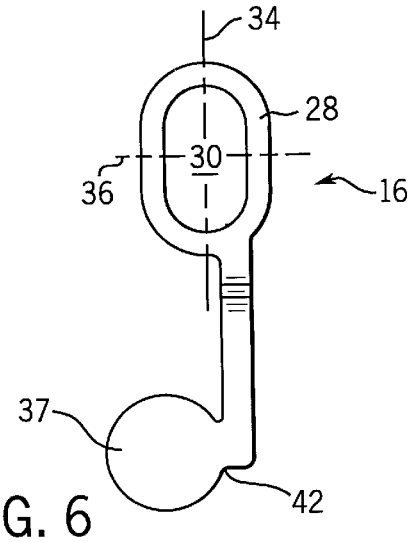
FIG. 6 is a view in cross section of the connector of FIG. 5.

As shown in FIG. 1, a bypass type shower door assembly (generally 10) is shown. It has blocks 12 mounted to each corner of doors 14. Linking connectors 16 are vertically slidably attached to each corner block 12. Connectors 16 are also horizontally slidably attached to the top and bottom curbs 18 in the direction of door travel, allowing the door 14 to be slid open or closed for access to a shower enclosure.

Shower door glass 14 is wedged into each deep channel 20 of a corner block 12. The blocks 12 are then fastened to the door glass using conventional means such as adhesives or screws (not shown).

Connector 16 is vertically slidably connected to the corner block 12 by providing each connector top portion 28 with a race track shaped slot 30 extending in the longitudinal direction in top portion 28. Each corner block 12 has a longitudinal cavity 22 with a hole 24 at each end of the cavity 22 in which the connector top portion 28 is inserted.

A pin 32 has an enlarged head 33 and is inserted through one of the holes 24 at the end of each corner block 12, then through slot 30 in the connector top portion 28, and then through the other hole 24 of the corner block 12. In this manner, the pin 32 retains the connector 16 while allowing the connector 16 to slide vertically along the pin 32. In the preferred embodiment, the pin 32 is a bolt which has peripheral threads which threadably engage one or both of the holes 24 in the corner block 12.

The race track shape of the connector slotted hole 32 has a long axis 34 and a short axis 36 that coincide with the centerline of the slotted hole 32 in the vertical and transverse directions.

Figure 2:
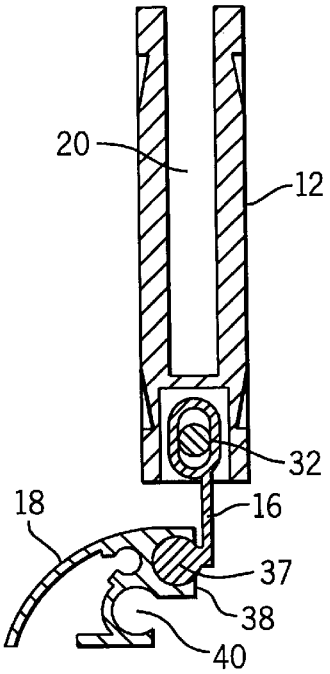
FIG. 2 is a view in cross section, taken on line 2—2 of FIG. 3.
Figure 3:
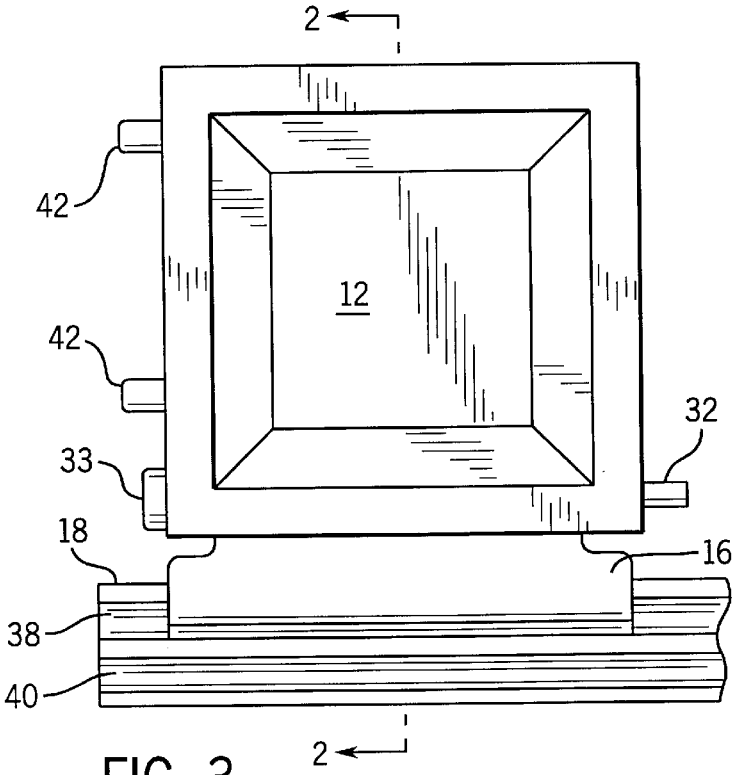
FIG. 3 is an enlarged rear elevational view of a corner block of the present invention that is linked to a guide rail (albeit without the door glass being shown)
Figure 4:
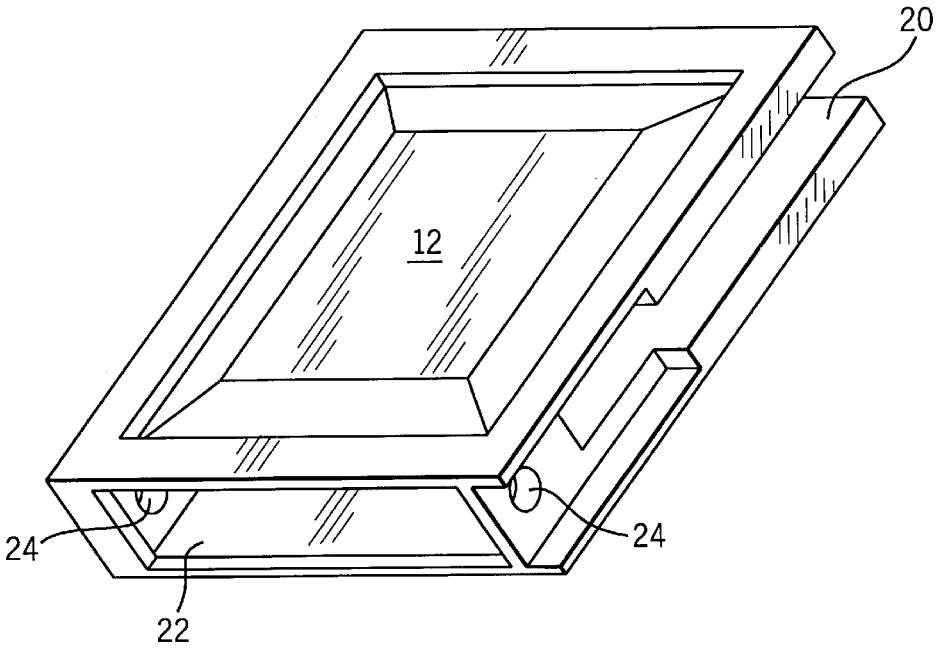
FIG. 4 is a right, bottom perspective view of the FIG. 3 corner block.

As best seen in FIGS. 2 and 3, the shower door 14 can move in the horizontal direction along the curb rail 18. The door 14 is retained by the cylindrical lobes 37 of each connector being slidably retained in a C-track 38 in each curb rail 18. The connector lobe 37 freely slides in the direction of door travel in a track 38 along the length of the curb 18.

As a result any debris or fluid that happens to enter a track 38 is ejected as the connector bottom portion 37 passes through, causing the track 38 to be self cleaning.

The connector bottom portion 37 and the curb rail 18 are assembled by sliding the connector bottom portion 37 into a lateral end of the track 38 prior to mounting the curb 18 at the shower opening. Curb 18 can then be securely mounted along the top and bottom of the shower opening by conventional means, such as screws or adhesives.

As shown in FIGS. 2 and 3, each curb rail 18 contains two tracks. The first track 38 is disposed above the second track 40 and is offset relative to the second track 40. This arrangement allows the operation of a second bypass shower door 10 having a lobe 37 that is extended to a greater extent from axis 34 by a lengthening area 42 (not shown). The exterior of the curb 18 can be a convex curvilinear shape to prevent the pooling of water on the exterior surface. Curbs 18 are preferably a continuously extruded metal such as aluminum. Elements 12 and 16 are preferably plastic.

As shown in FIG. 3, bumpers 42 can be mounted on the corner block 12 adjacent to the shower enclosure wall. They protect the door 14 from damage that might otherwise be caused by the door violently striking the enclosure wall when the door 14 is opened or closed. Bumpers 42 may also cover screws used to mount the corner block 12 to the shower door 14.

In use, the assembly permits the door to "float" relative to the curb rails 18, thereby correcting for out of plumb conditions. The above is considered to be the preferred embodiment of the invention. However, those skilled in the art will appreciate that various changes and modifications can be made without departing from the scope of the invention as defined by the appended claims.

For example, instead of using a pin inserted into a side to side slotted hole, a pin or pins could be inserted through slotted holes in the front to back direction. Also, one could hang a shower door using conventional methods and secure only the door bottom using the present invention. Thus, the claims should be looked to in order to judge the full scope of the invention.

I claim:

1. A shower door assembly comprising;

a door;

a block on the door adjacent an edge of the door;

a connector vertically slidably linked to the block; and a curb rail longitudinally slidably connected to the connector.

2. A shower door assembly as in claim 1, wherein the block has a cavity with end holes at opposed ends of the cavity.

3. A shower door as in claim 2, wherein the connector has a top and a bottom, the top having a slotted hole longitudinally extending therethrough that is inserted into the cavity, the slotted hole having a vertical centerline, the bottom having a connection portion, the bottom connection portion being offset from said vertical centerline of the slotted hole.

4. A shower door as in claim 3, wherein said bottom connection portion is cylindrical.

5. A shower door as in claim 3, wherein said curb rail has a c-shaped track for receiving the bottom connection portion.

6. A shower door as in claim 2, wherein the connector top is vertically slidably attached to the block by a pin inserted into the end holes of the block and the slotted hole of the connector top.

7. A shower door assembly of claim 6, wherein the pin is threadably engaged with one or more of the end holes.

8. A shower door assembly of claim 1, wherein said block has at least one bumper.

* * * * *